United States Patent [19]

Kromrey

[11] Patent Number: 4,836,420

[45] Date of Patent: Jun. 6, 1989

[54] CLEANING IN PLACE VALVE ACTUATOR

[75] Inventor: Edward P. Kromrey, Osceola, Wis.

[73] Assignee: Ecolab Inc., St. Paul, Minn.

[21] Appl. No.: 1,685

[22] Filed: Jan. 9, 1987

[51] Int. Cl.[4] ..... B67D 1/08

[52] U.S. Cl. ..... 222/148; 137/240; 251/129.11; 134/166 R; 222/504; 222/129.1

[58] Field of Search ..... 137/239, 240; 251/129.11, 129.2; 134/166 R, 167 R, 169 R; 222/148, 504, 505, 129.1, 129.2, 190

[56] References Cited

U.S. PATENT DOCUMENTS

| | | | |
|---|---|---|---|
| 3,086,563 | 4/1963 | Patten et al. | 141/69 |
| 3,830,407 | 8/1974 | Wierlo | 222/145 |
| 3,839,881 | 10/1974 | Calim | 62/340 |
| 3,898,861 | 9/1975 | McMillin, Jr. | 222/148 |
| 3,934,427 | 1/1976 | Keyes | 62/342 |
| 3,934,759 | 1/1976 | Giannella | 222/129 |
| 3,961,494 | 6/1976 | Schaefer | 62/73 |
| 4,111,243 | 9/1978 | Fetterman | 251/129.2 |
| 4,261,397 | 4/1981 | Guy | 141/1 |
| 4,508,142 | 4/1985 | Edurn et al. | 251/129.11 |

*Primary Examiner*—H. Grant Skaggs

*Attorney, Agent, or Firm*—Merchant, Gould, Smith, Edell, Welter & Schmidt

[57] ABSTRACT

Disclosed is a cleaning-in-place valve actuator (23) for cleaning a soft serve shake machine (10). The valve actuator (23) is mounted upon the front of the soft serve shake machine (10), and a motor (20) moves a series of mechanical linkages (15, 11) so that a shifting fork (8) pivotally and reciprocally rotates. The forked ends (64) of the shifting fork (8) attach to levers (42) on the soft serve shake machine (10) and cause the lever (42) to move back and forth. The movement of the lever (42) opens and closes a draw valve (40) which controls flow to the machine's outlet nozzle (31), so that the cleaning solution can flow to all parts of the soft serve shake machine (10) for thorough cleaning.

13 Claims, 4 Drawing Sheets

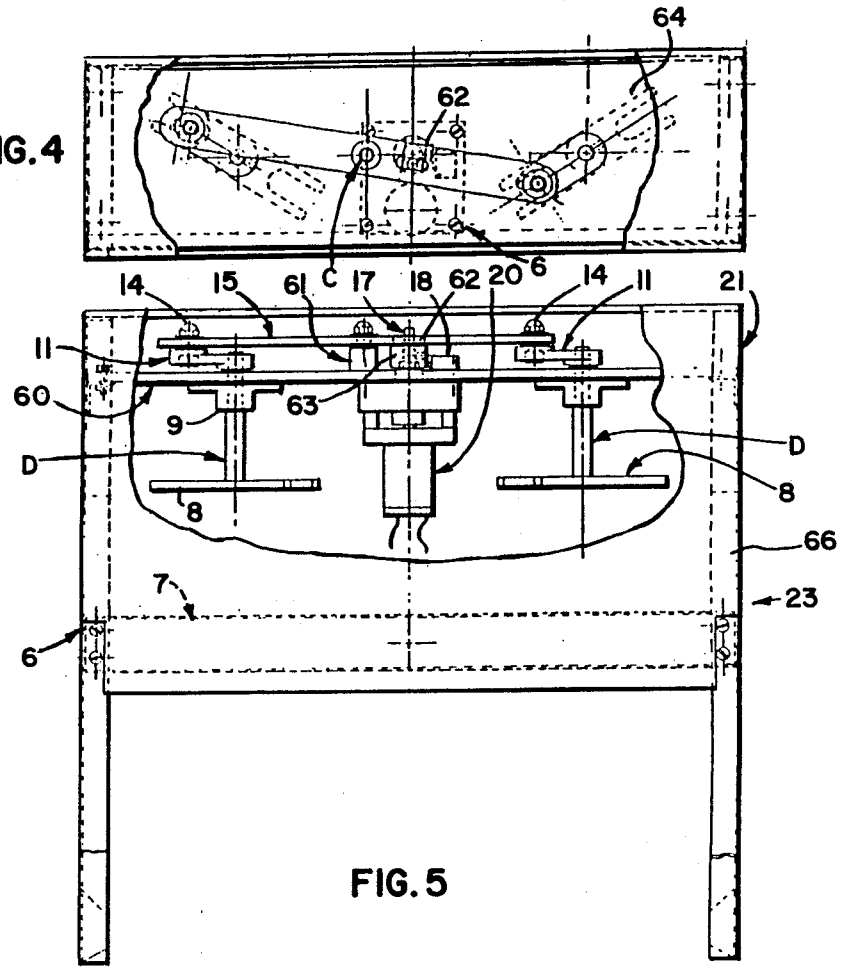
FIG. 4
FIG. 5
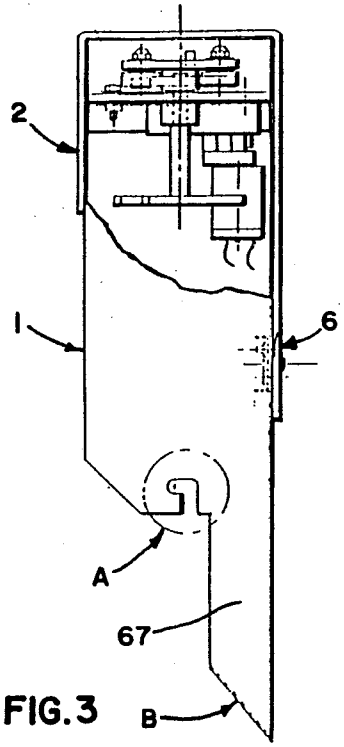
FIG. 3

CLEANING IN PLACE VALVE ACTUATOR

BACKGROUND OF THE INVENTION

1. Field of the Invention

This invention relates to the cleaning of dispensers for fluid products, and more particularly to an apparatus for automatically actuating a dispenser valve during the cleaning process.

DESCRIPTION OF RELATED TECHNOLOGY

Fast food service restaurants frequently install soft ice cream machines and milkshake machines. In general, the machine releases portions of ice cream or milkshake from a dispensing valve of the machine immediately prior to serving the customer. The draw or dispensing valve is operated by the vendor to dispense servings of ice cream or milkshake into a cone or cup in controlled amounts.

Cleaning of such machines can often be a labor-intensive and time-consuming process. Typically, the machine must be flushed with warm water repeatedly, the water being supplied from two or three gallon pails. Next, a chlorine solution must be run through the machine. The machine must then be dismantled, undergoing a wash, rinse and sanitizing process in a three compartment sink. This is usually performed at the end of the day, and the machine is reassembled the next morning and again flushed with a chlorine solution. This process tends to be unreliable, and there is a temptation to take shortcuts on the part of the cleaning personnel. Also, the cleaning procedure is undesirable because of the wear and tear on the machine resulting from the dismantling process.

Finally, the components surrounding the dispensing valves on a soft serve shake machine are difficult to reach, are too complex to be repeatedly dismantled, and often remain hidden throughout the cleaning process. Furthermore, since the draw valve is in the static position during the cleaning process, the portion of the valve mechanism near the outlet nozzle is blocked from the cleaning solution unless the valve is repeatedly opened and closed during the cleaning cycle. Such operation would require the manual intervention of an operator and would be prohibitively expensive and time-consuming. As a result, dismantling of the machine is typically required to clean the entire draw valve area, with the accompanying problems of increased expense, time, effort, and wear on the machine.

SUMMARY OF THE INVENTION

The invention is a valve actuating device used to facilitate the cleaning of a soft serve ice cream and milkshake dispensing machine. The invention permits the "cleaning in place" of the soft serve machine, eliminating the necessity for dismantling the machine and substantial manual cleaning of the machine. The present invention is mounted by means of two hooks onto the front of a soft serve shake machine. The device includes an electric motor operating at approximately 20 revolutions per minute, the motor operating through a series of mechanical linkages to cause a reciprocating movement of two shifting fork members. The fork are positioned so as to grip the valve handles or levers on the soft serve shake machine draw valves, the reciprocating movement of the fork members thereby simulating the manual operation of the soft serve shake machine. The continuous opening and closing of the draw valve during the cleaning cycle ensures that the cleaning solution will reach all parts of the machine's assembly, and eliminates the necessity for substantial manual cleaning. As a result, the present invention saves on labro time and expense. Its smooth reciprocal motion also eliminates the wear on the machine resulting from dismantling.

Another advantage of the present invention is that it is simple to use. The device can be easily mounted upon and removed from the soft serve machine. Also, the device can be left unattended or overnight while the cleaning procedure takes place.

These and various other advantages and features of novelty which characterize the invention are pointed out with particularity in the claims annexed hereto and forming a part hereof. However, for a better understanding of the invention, its advantages, and objectives attained by its use, reference should be had to the drawings which form a further part hereof and to the accompanying descriptive matter, in which there is illustrated and described the preferred embodiment of the invention.

BRIEF DESCRIPTION OF THE DRAWINGS

FIG. 3 is a partial fragmentary side elevation of a valve actuating device constructed according to the principles of the present invention;

FIG. 4 is a plan view of the valve actuating device as shown in FIG. 3;

FIG. 5 is a front elevation of the device as shown in FIG. 3;

DETAILED DESCRIPTION OF THE PREFERRED EMBODIMENT

Figure 1:
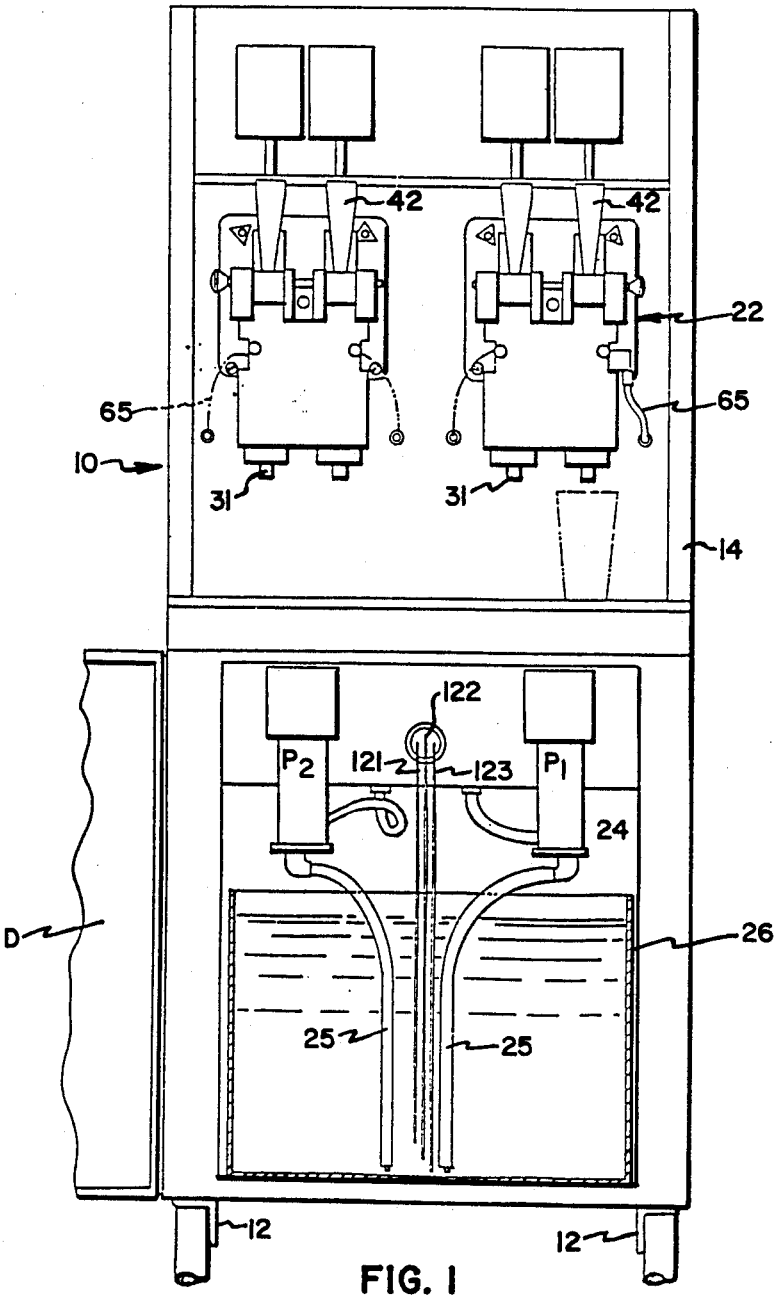
FIG. 1 PRIOR ART
FIG. 1 is a front elevation of a soft serve shake machine.

Reference is now made more particularly to the drawings which illustrate the best presently known mode of carrying out the invention and wherein similar reference characters indicate the same parts throughout the several views. In order to more fully understand the function of the draw valve actuating device, some background discussion of the soft serve shake machine to which the present invention is attached is necessary. This dispensing machine is described in greater detail in U.S. Pat. No. 3,934,427 issued Jan. 27, 1976 to Richard M. Keyes. Reference is made to that patent for a more detailed description.

As illustrated in FIG. 1, an ice cream or milkshake dispensing machine 10 includes frame members 12 supporting a housing 14, portions of which are removed for better illustration of the parts. The machine 10 is one which produces a semi-frozen confection which is mixed with a flavoring syrup to form a milkshake when drawn from the machine. A valve block 22 is at the front of the machine. The flavoring syrup used in making the confections is delivered under pressure to the valve block 22 through a syrup conduit 65.

The valve block 22 is designed to provide a closure for the outlet of the machine. It is held in place by a plurality of fasteners 28 best illustrated in FIG. 2. Each valve block 22 has a pair of outlet nozzles 31 at the bottom of respective elongate chambers 32 through which the ice cream or milkshake is dispensed. Elongate chambers 32 communicate with a distributor chamber (not shown) which, in turn, communicates with a freezing compartment (not shown), both of which are located behind the valve block 22.

A door D at the front of the machine 10 leads to a refrigerated compartment 24 which holds a liquid confection storage hopper 26, as illustrated in FIG. 1. In the embodiment illustrated, a pump P1 is provided with an inlet drive 25 through which it can withdraw the liquid confection and pump it through conduit 27 to the freezer unit (not shown) located behind the valve block 22. A second pump P2 is provided for similarly pumping the liquid confection to the second freezer unit (not shown).

Figure 2:
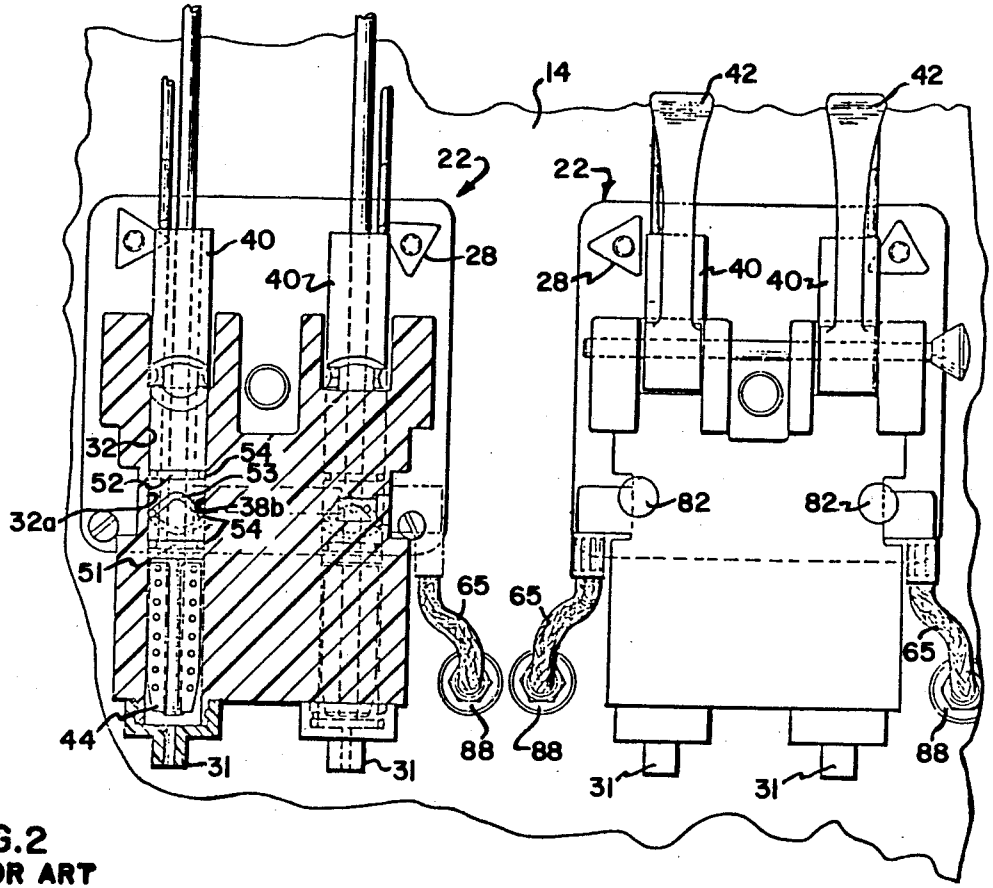
FIG. 2 PRIOR ART
FIG. 2 is a fragmentary view of two valve blocks, one being shown in elevation and the other being shown in section, of a soft serve shake machine.

As illustrated in FIG. 2, disposed within each elongate chamber 32 is a drive shaft 34 surrounded by a sleeve (not shown) of suitable bearing material. The sleeve is surrounded by a valve element 40 which is reciprocally movable in a vertical direction by means of lever 42. At the bottom end of drive shaft 34 is affixed a rotary beater 44 which blends the soft ice cream and flavoring material into a milkshake or flavored soft ice cream before it is dispensed through the outet nozzle 31. A finger 45 engages the top of the valve element 40 and is arranged to throw a switch (not shown) when the valve element is raised. The switch controls a drive motor having a driving connection to shaft 34. Thus, the beater 44 is driven only when the valve member 40 is raised to an open position. Lever 42 is actuated by the operator when it is desired to make a milkshake, which causes the beater 44 to mix the soft ice cream and flavoring syrup before delivery through outlet nozzle 31.

Valve member 40 contains means which are operative in the closed downward position to block flow of the soft ice cream and flavoring to the dispensing outlet 31. For this purpose, a pair of parallel grooves 51 and 52 are arranged perpenicular to the axis of valve member 40. A third groove 53 is located intermediate to the grooves 51 and 52 and is canted or inclined relative to them. Each groove has a sealing ring in the form of an O-ring 54 disposed therein for sealing against the inside of elongate chamber 32. Preferably, the intermediate groove 53 is shallower than grooves 51 and 52, and the O-rings are of identical size and made of elasomeric material. Located between the grooves 51 and 52 are inlet ports **32*a* and 32*b* which open into the elongate chamber 32. Soft ice cream is fed from the freezing compartment (not shown) through the inlet port 32*a*. Flavoring syrup is fed from tanks (not shown) at the rear of the machine 10 to inlet port 32*b*. Ports 32*a* and 32*b* are at about the same vertical level in the chamber 32 or, in other words, are spaced about an equal distance from the outlet of nozzles 31. When the valve member 40 is in its closed downward position as shown in FIG. 2, the grooves and sealing rings prevent the soft ice cream and flavoring syrup from flowing down the elongate chamber 32 and out the outlet nozzle 31. When the operator pushes the lever 42, the valve member 40 raises so that the grooves and sealing rings are above the inlet ports 32*a* and 32*b*, and the soft ice cream and flavoring syrup may be mixed and dispensed through outlet nozzle 31**. With this valving arrangement, no additional shutoff valves are required to control the flow of the soft ice cream and flavoring material.

In order to provide the desired consistency, it is necessary that the pumps P1 and P2 be provided with an adequate supply of liquid comestible in storage hopper 26. To assure this, a plurality of electrical probes 121, 122 and 123 are provided. As can be seen in FIG. 1, these probes extend to three different levels adjacent to the bottom of storage hopper 26. The lowermost probe 123 is a common line; the shortest probe 121 is operatively wired to control a warning light (not shown) which is switched on when the liquid level falls below probe 121. Probe 122, of intermediate length, is wired to controls which are arranged to interrupt the functional operation of the machine when the liquid level falls below probe 122. In this manner, a warning light tells the operator when additional liquid comestible should be added to the storage hopper 16 and, if it is not added in time, the operation is shut down. By shutting down the machine, one is assured that it is operative only when the proper proportions of liquid comestible and air are fed to the freezing chambers. This assures the quality of the milkshakes being dispensed and reduces maintenance problems.

As shown in FIG. 2, a headed pin 82 retains coupling 74, which connects flavoring conduit 65 to elongate chamber 32 within valve block 22. Upon withdrawal of pin 82, coupling 74 can be removed from the valve block 22 for cleaning purposes. The flavoring conduit 65 is adjacent to the front of the machine outside the surface of housing 14. The connection of conduit 65 to the housing 14 is made by a quick-disconnect coupling 88 of the double end shutoff type. As is conventional, such double end shutoff type disconnect coupling incorporate a check valve in both portions of the coupling which close when the coupling portions are uncoupled. To clean conduit portion 65 and/or the valve block 22, the quick-disconnect coupling 88 is first released, pin 88 is withdrawn from the valve block 22, and then coupling 74 is removed.

Figure 6:
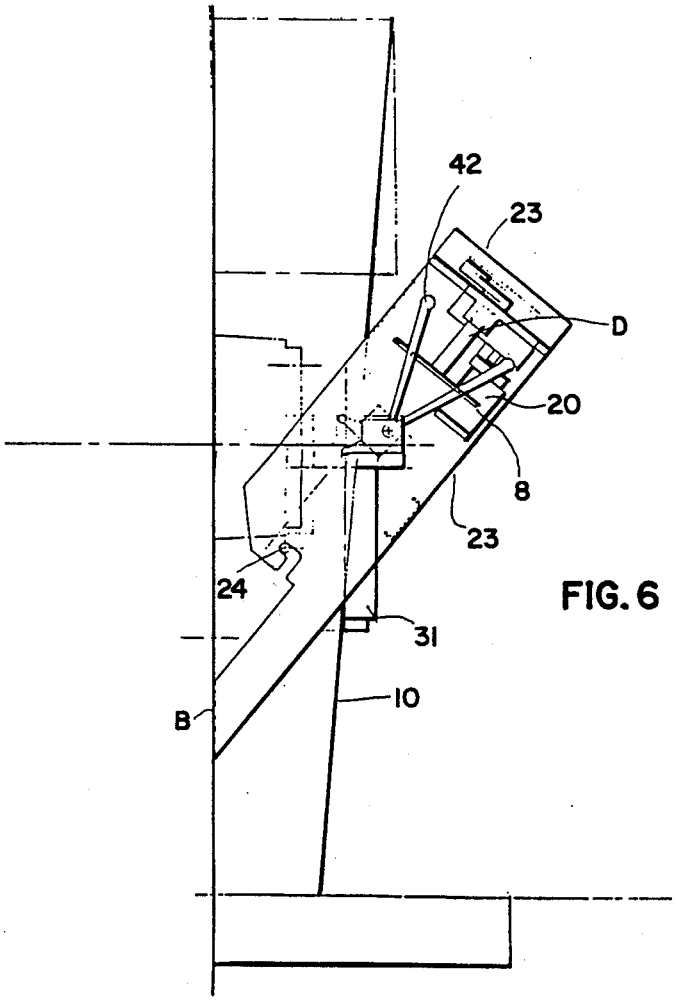
FIG. 6 is a side elevation showing the valve actuating device of FIG. 3 mounted in place on a soft serve shake machine.

A valve actuator constructed according to the principles of the present invention is shown generally at 23 in FIGS. 3–6. Valve actuator 23 is affixed to ice cream or milkshake dispensing machine 10 be means of hooked cutouts A which slide over mounting studs 24, shown in FIG. 6, on the dispensing machine. Unit 23 is further supported by feet B which are the base ends of side plates 1 and 21. Positioned between the side plates 1 and 21 of actuator support 66 are a mounting base 60 and a cross bar 7. The actuator support members 1, 21, 66 and 60 are preferably made of metal. The side plates 1 and 21 are dimensioned so that the valve actuator 23 fits properly with the standard ice cream or milkshake dispensing machine 10. The dimensions of the actuator support of the preferred embodiment are preferably seventeen and one-half (17½) inches in frontal width, five and three-eighths (5⅜) inches in depth, nineteen and one-fourth (19¼) inches in length at the front, and eleven (11) inches in length at the rear. The side plates 1 and 21 are configured to have narrow leg portions 67. The feet B are angled appropriately so that the feet B of the valve actuator 23 rest against a frontal wall of the dispensing machine 10 when installed in place, as shown in FIG. 6. The cross bar 7 provides stabilty to the valve actuator 23 and also enables the user to handle the device more easily. The cross bar 7 is attached to the side plates 1 and 21 with suitable fasteners 6, such as screws.

Mounted within the actuator support 66 is an electric motor 20. The motor operates at approximately twenty (20) revolutions per minute, and an output shaft 63 extends through an aperture in the mounting plate 60. The motor is provided with a switch 18. Securedly mounted upon the output shaft 63 is an eccentric slider crank 17. A substantially flat slider arm 15 is positioned above and substantially parallel to the mounting base 60. This slider arm 15 is connected to the mounting base 60 by means of a pivot post 61 located at point C. The pivot post 61 is preferably positioned to be at about the center of the slider arm 15 and extends through a central aperture in the slider arm. The slider arm 15 includes a longitudinal slot 62 located to one side of the pivot post 61, through which the eccentric slider crank 17 of the motor's output shaft 63 is inserted. The longitudinal slot 62 is preferably positioned closer to the pivot post 61 than to end of the rocker arm 15. When the motor's output shaft 63 rotates, the eccentric slider crank 17 rotates therewith, and slideably engages the edges of the longitudinal slot 62, causing the slider arm 15 to reciprocally pivot about the pivot post 61. Two rocker arms 11 are located between and substantially parallel to the slider arm 15 and the mounting base 60. Each substantially flat rocker arm 11 is preferably approximately one-fourth (¼) of the length of the slider arm 15. One end of each of the rocker arms 11 is pivotally connected to one end of the slider arm 15. This pivotal connection is preferably made by means of a pin and shoulder screw 14. As shown in FIG. 4, the outside end of the left rocker arm 11 is connected to the slider arm 15, whereas the inside end of the right rocker arm 11 is so connected to the slider arm 15. Each end of the rocker arms 11 which is not connected to the slider arm 15 has an aperture which accommodates a substantially vertical shaft D. The two shafts D extend from the rocker arms 11 and through apertures in the mounting base 60. This shaft assembly D is secured to the underside of the mounting base 60 by a bearing block 9 which surrounds each shaft D and is connected to the bottom surface of the mounting base 60. The shaft D is substantially perpendicular to the mounting base 60 and the rocker arm 15, and it is located within the actuator support 66. At the opposite, bottom end of each shaft D is a shifting fork 8 rigidly connect to the shaft D. The shaft D preferably connects to the shifting fork 8 at its center. In the preferred embodiment, the slider arm 15, the rocker arms 11, and the shifting forks 8 are made of plastic.

It is to be understood the other mechanical linkages can be devised which would cause the shifting forks 8 to reciprocally pivot. The present invention is meant to encompass such design changes, including changes in lengths of the components, materials used, and angles of travel.

Attached to each of the two substantially vertical shafts D is a shifting fork 8, and each shifting fork 8 has two forked ends 64. When two shifting forks 8 are provided, as shown in FIG. 5, and each shifting fork 8 has a forked end 64 at each end, a maximum of four levers 42 can be actuated back and forth during the cleaning process in the preferred embodiment.

For safety and aesthetic reasons, a removable cover 2 is also provided for the valve actuator 23. It is substantially U-shaped, having a front and back portion, and a top portion therebetween which is substantially parallel to and spaced above the mounting base 60. The front portion of the cover 2 preferably extends down to a level proximate the cross bar 7.

Figure 7:
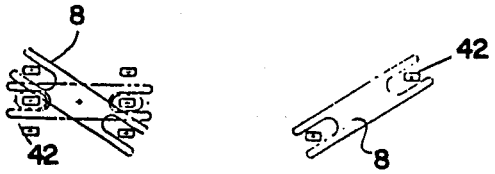
FIG. 7 is a diagrammatic plan view of the fork members as utilized in the present invention showing their relative movement.

In operation, the motor 20 causes the output shaft 63 to rotate. The eccentric crank 17 rotates with the output shaft 63 and slidably engages the longitudinal slot 62 of the slider arm 15. The rotation of the eccentric slider crank 17 causes the slider arm 15 to pivot at point C, where the pivot post 61 is located. The back and forth motion of the slider arm 15 causes the rocker arms 11 to similarly pivot back and forth about the shaft D. The pivoting force radiates down shafts D and causes the shifting forks 8 to reciprocally rotate. In the preferred embodiment, the reciprocal pivotal rocker motion of the shifting forks 8 corresponds to about sixty-five degrees (65° ) of angular displacement within the plane, occupied by the shifting forks. The motion of the shifting forks 8 is such that the forked ends 64 travel the same direction for the same distance at the same time. Each forked end 64 is sized and configured to grip onto a lever 42. The reciprocal motion of the forked end 64 causes the lever 42 to be pushed back and forth consecutively, which causes the valve member 40 to open and close. The smooth motion of this mechanism is required to prevent any undue wear on the ice cream or milkshake dispensing machine, and to simulate manual operation of the draw valves. The reciprocal motion of these levers 42 causes the internal valves 40 of the fluid dispensing machine to open and close and thereby allows the cleaning solution to access all parts of the machine for thorough cleaning. FIGS. 6 and 7 illustrate how the present invention moves one lever 42 to a closed, backward position while moving the adjacent lever 42 to an open, foward position. The positioning of these two adjacent levers 42 reciprocates with the pivotal reciprocal movement of the shifting fork 8.

At the end of the day, the valve actuator 23 of the present invention can be installed onto the ice cream or milkshake machine 10. The cleaning solutions are then pumped through the machine 10 as is commonly done in the art, all the while the valve actuator 23 of the present invention working to open and close the valves so as to thoroughly clean the machine. In the morning, the valve actuator 23 can be easily removed from the machine 10 so that the cleansed soft serve shake machine can be used.

It is to be understood that numerous and varied modifications can be readily devised in accordance with the principles of the present invention by those skilled in the art without departing from the spirit and scope of the invention. Therefore, it is not desired to restrict the invention to the particular constructions illustrated and described, but to cover all modifications that may fall within the scope of the appended claims.

I claim:

1. A cleaning-in-place value actuator for causing oscillating movement of a lever on a fluid dispensing machine, movement of said lever controlling a valve which controls flow to an outlet nozzle on said dispensing machine, said valve actuator comprising:

(a) an actuator support which operatively attaches to said fluid dispensing machine proximate said levers;

(b) a motor mounted to said actuator support having a rotatable output shaft;

(c) a shifting fork mounted to said actuator support, having at least one forked end which operatively attaches to said lever on said fluid dispensing machine; and (d) conversion means for converting the rotary motion of said motor output shaft to reciprocal pivotal motion of said shifting fork, so that the reciprocal motion of said forked end causes said lever to move back and forth, thereby opening and closing said valve of said fluid dispensing machine, wherein the conversion means comprises:

i. an eccentric slider crank mounted upon said motor output shaft;

ii. a slider arm attached to and spaced apart from said activator support, said slider arm having a longitudinal slot therein which accommodates and slidably engages said eccentric slider crank;

iii. a rocker arm parallel to and spaced between said actuator support and said slider arm, having a first and second end, said first and end being pivotally connected to said slider arm;

iv. a shaft, one end operatively connected to said second end of said rocker arm, the opposite end operatively connected to said shifting fork, wherein the rotation of said motor output shaft causes said slider arm, said rocker arm, and said shifting fork to pivot reciprocally, so that the reciprocal motion of said forked end causes said levers to move back and forth, thereby opening and closing said valves of said fluid dispensing machine.

2. A cleaning-in-place valve actuator for causing oscillating movement of a lever on a fluid dispensing machine, movement of said lever controlling a valve which controls flow to an outlet nozzle on said dispensing machine, said valve actuator comprising:

(a) an actuator support which operatively attaches to said fluid dispensing machine proximate said levers;

(b) a motor mounted to said actuator support having a rotatable output shaft;

(c) a shifting fork mounted to said actuator support, having at least one forked end which operatively attaches to said lever on said fluid dispensing machine; and (d) conversion means for converting the rotary motion of said motor output shaft to reciprocal pivotal motion of said shifting fork, so that the reciprocal motion of said forked end causes said lever to move back and forth, thereby opening and closing said valve of said fluid dispensing machine, i. an eccentric slider crank mounted upon said motor output shaft;

ii. a slider arm attached to and spaced apart from said activator support, said slider arm having a longitudinal slot therein which accommodates and slideably engages said eccentric slider crank;

iii. two rocker arms, each rocker arm being pivotably connected to each end of said slider arm, each rocker arm corresponding to a shaft having two forked ends, whereby four separate levers and four corresponding valves may be actuated simultaneously; and iv. a shaft, one end operatively connected to said second end of said rocker arm, the opposite end operatively connected to said shifting fork, wherein the rotation of said motor output shaft causes said slider arm, said rocker arm, and said shifting fork to pivot reciprocally, so that the reciprocal motion of said forked end causes said levers to move back and forth, thereby opening and closing said valves of said fluid dispensing machine.

3. A cleaning-in-place valve actuator for causing oscillating movement of a lever on a fluid dispensing machine, movement of said lever controlling a valve which controls flow to an outlet nozzle on said dispensing machine, said valve actuator comprising:

(a) an actuator support having two substantially parallel side plates and a mounting base therebetween with an upper and lower surface, said side plates each having fasteners which attach to said fluid dispensing machine;

(b) a motor mounted within said actuator support, having a rotatable output shaft extending through an aperture in said mounting base, said output shaft having an eccentric slider crank thereon;

(c) a slider arm substantially parallel to and spaced above said upper surface of said mounting base and pivotally connected thereto, said slider arm having a longitudinal slot therein which accommodates and slidably engages said eccentric slider crank;

(d) a rocker arm substantially parallel to and spaced between said mounting base and said slider arm, having a first and second end, said first end being pivotally connected to said slider arm;

(e) a shaft having a top and bottom end, said top end extending through apertures in said mounting base and said second end of said rocker arm, said shaft being substantially perpendicular to said mounting base and rocker arm; and (f) a shifting fork substantially parallel to said mounting base and positioned within said actuator support, said shifting fork having at least one forked end and being rigidly connected to said bottom end of said shaft for reciprocal pivotal motion, wherein the rotation of said motor output shaft causes said slider arm, said rocker arm, and said shifting fork to pivot reciprocally so that the reciprocal motion of said forked end causes said levers to move back and forth consecutively, thereby opening and closing said valves of said fluid dispensing machine.

4. The cleaning-in-place valve actuator according to claim 3, further comprising a substantially U-shaped cover which removably attaches to said activator support, having front and back portions and a top portion therebetween.

5. The cleaning-in-place valve actuator according to claim 3, wherein said fasteners which connect said valve actuator to said fluid dispensing machine comprise a hook rigidly connected to each side plate which accommodates a mounting stud on said machine, and a foot rigidly connected to each side plate which bears against said machine when said valve actuator is installed in place.

6. The cleaning-in-place valve actuator according to claim 3, further comprising a pivot post mounted upon said mounting base and extending through an aperture in said rocker arm, wherein said rocker arm pivots about said pivot post when said motor output shaft is rotated.

7. The cleaning-in-place valve actuator according to claim 3, wherein said pivot post is positioned at the center of said rocker arm and said longitudinal slot is positioned closer to said pivot post than to an end of said rocker arm.

8. The cleaning-in-place valve actuator according to claim 3, wherein said valve actuators includes two rocker arms, each rocker arm being connected to each end of said slider arm, each rocker arm corresponding to a shaft having two forked ends, whereby four separate levers and four corresponding valves may be actuated simultaneously.

9. The cleaning-in-place valve actuator according to claim 3, wherein said actuator support is made of metal.

10. The cleaning-in-place valve actuator according to claim 3, wherein said slider arm, rocker arm and shifting fork are made of plastic.

11. A cleaning-in-place valve actuator for causing oscillating movement of a lever on a fluid dispensing machine, movement of said lever controlling a valve which controls flow to an outlet nozzle on said dispensing machine, said valve actuator comprising:

(a) an actuator support having two substantially parallel side plates, a mounting base therebetween with an upper and lower surface, and cross bar therebetween, said side plates having an integral hook and foot to attach said valve actuator to said fluid dispensing machine;

(b) a substantially U-shaped cover which removably attaches to said activator support, having front and back portions and a top portion therebetween;

(c) a motor mounted within said actuator support, having a rotatable output shaft extending through an aperture in said mounting base, said output shaft having an eccentric slider crank thereon;

(d) a slider arm substantially parallel to and spaced above said upper surface of said mounting base, said slider arm having a central aperture to accommodate a pivot post mounted upon said mounting base, said slider arm having a longitudinal slot therein which is closer to said pivot post than to an end of said slider arm and which accommodates and slideably engages said eccentric slider crank;

(e) two rocker arms substantially parallel to and spaced between said mounting base and said slider arm, each having a first and second end, said first ends being pivotally connected to each end of said slider arm;

(f) two shafts each having a top and bottom end, said top ends extending through apertures in said mounting base and said second end of said rocker arm, said shafts being substantially perpendicular to said mounting base and rocker arm; and (g) two shifting forks substantially parallel to said mounting base and positioned within said actuator support, said shifting forks having two forked ends and being rigidly connected to said bottom end of said fork shaft for reciprocal pivotal motion, wherein the rotation of said motor output shaft causes said slider arm, said rocker arms, and said shifting forks to pivot reciprocally so that the reciprocal motion of said forked ends causes up to four of said levers to move back and forth consecutively, thereby opening and closing said valves of said fluid dispensing machine.

12. The cleaning-in-place valve actuator according to claim 11, wherein said actuator support is made of metal.

13. The cleaning-in-place valve actuator according to claim 11, wherein said slider arm, rocker arm and shifting fork are made of plastic.

* * * * *